US006343397B1

(12) United States Patent
Odagiri

(10) Patent No.: US 6,343,397 B1
(45) Date of Patent: Feb. 5, 2002

(54) WINDING ADHESIVE CLEANER

(76) Inventor: Akihiko Odagiri, 1609-2 Fukujima, Ina, Nagano, 396-0001 (JP)

( * ) Notice: Subject to any disclaimer, the term of this patent is extended or adjusted under 35 U.S.C. 154(b) by 0 days.

(21) Appl. No.: 09/928,712

(22) Filed: Aug. 13, 2001

(30) Foreign Application Priority Data

Sep. 7, 2000 (JP) ..... 12-314480

(51) Int. Cl.[7] ..... A47L 25/00
(52) U.S. Cl. ..... 15/104.002; 15/230.11
(58) Field of Search ..... 15/104.002, 230.11, 15/231, 233

(56) References Cited

U.S. PATENT DOCUMENTS 3,883,921 A * 5/1975 Thettu et al. ..... 15/104.002
4,391,014 A * 7/1983 Pitzen ..... 15/231
4,575,890 A * 3/1986 Hidle ..... 15/104.002
4,640,539 A * 2/1987 La Porte ..... 15/104.002

* cited by examiner

*Primary Examiner*—Gary K. Graham

(57) ABSTRACT

A winding adhesive cleaner according to the invention comprises a body (shown in FIG. 2) equipped with a gear box (2) and an attachable cylinder (shown in FIG. 1) equipped a rolled strip of adhesive paper. Adhesive face on the cleaner is continuously changed without removing dirtied face or suspending cleaning operation. And cleaning operation can be very sanitary because it is unnecessary to touch dirty adhesive face directly with fingers. Furthermore, the cylinder after consumed can be thrown away as a combustible waste.

1 Claim, 3 Drawing Sheets

WINDING ADHESIVE CLEANER

FIELD OF THE INVENTION

The present invention relates to winding adhesive cleaner which attracts dust onto strip of adhesive paper.

BACKGROUND OF THE INVENTION

A conventional cleaner with adhesive paper has the construction that rolled paper applied with glue is fit to the shaft and it is rolled on the floor to collect dust or dirt. If adhesion power is lowered due to collected dust, it is required to cut the paper along the perforations to serve fresh face of adhesive paper.

Said conventional cleaner, which is only focused on cleaning with glue, has the inconveniences as follows:

(1) A batch of adhesive paper is fixed with the length of circumference of the paper roll, which is easily dirtied to spoil adhesive power.

(2) It is hard to find the location of perforations due to dust collected, resulting in extra time to serve fresh face.

(3) It is insanitary and feels bad to handle the adhesive paper dirtied with dust.

(4) It often takes more time to prepare fresh adhesive surface than the time for actual cleaning. It means that the whole cleaning time is prolonged to spoil the merit of easy cleaning method.

(5) In conclusion, cleaning with a conventional tool is insanitary and takes much time.

SUMMARY OF THE INVENTION

To solve the above problems, the present invention comprises a roll of adhesive paper (1), a cylinder (3) having an opening (4) in the length direction and end plates (5) and (6) on both ends, the end plates being equipped with center holes (7) and (11), an unwinding shaft **(8*a*) with socket holes (16*b*) and a winding shaft (9*a*) with socket holes (17*b*), either of the end plates being equipped with a stopper (12) on the center hole (11), a gear box (2) having a center shaft (10) equipped with a one-way bearing (18), a driving gear (19) and an arm with backstop claw (22), the center shaft having a stopper channel (15) at the top and connecting to a handle (25), the driving gear engaging a winding gear (20) with a winding gear shaft (14) equipped with projections (17*a*), a claw of said arm (22) connecting to a ratchet gear (21) with an unwinding gear shaft (13) equipped with projections (16*a*), and a construction wherein said center shaft (10) penetrates said center holes (7) and (11) to fit in said stopper (12) at said stopper channel (15), said projections (16*a*) fitting in socket holes (16*b*) at the end of the unwinding shaft (8*a*), said projections (17*a*) fitting in socket holes (17*b*) at the end of the winding shaft (9*a*), and said roll of adhesive paper being set to the unwinding shaft (8*a*)**.

Said winding adhesive cleaner according to the invention consists of two major parts; main body (shown in FIG. 2) including said gear box (2) and said cylinder (3) set with adhesive paper. Said cylinder (3), with a roll of adhesive paper set to the unwinding shaft **(8*a*) and also to the winding shaft (9*a*), is easily attached to said gear box (2)** or easily taken off from the same as a consumable.

BRIEF DESCRIPTION OF THE DRAWINGS

The objects and features of the present invention will become more apparent from the consideration of the following detailed description taken in conjunction with the accompanying drawings in which.

Explanation for the symbols

| | | | |
|---|---|---|---|
| 1: | Roll of adhesive paper, | 2: | Gear box, |
| 3: | Cylinder | 4: | Opening, |
| 5: | End plate, | 6: | End Plate, |
| 7: | Center hole, | 8a: | Unwinding shaft, |
| 8b: | Supporting hole for unwinding shaft, | | |
| 8c: | Supporting hole for unwinding shaft, | | |
| 9a: | Winding shaft, | | |
| 9b: | Supporting hole for winding shaft, | | |
| 9c: | Supporting hole for winding shaft, | | |
| 10: | Center shaft, | 11: | Center hole |
| 12: | Stopper, | 13: | Unwinding gear shaft, |
| 14: | Winding gear shaft | 15: | Stopper channel, |
| 16a: | Projections, | 16b: | Socket holes, |
| 17a: | Projections | 17b: | Socket holes, |
| 18: | One-way bearing | 19: | Driving gear |
| 20: | Winding gear, | 21: | Ratchet gear, |
| 22: | Arm with backstop claw, | 23: | Spring, |
| 24: | Winding hole, | 25: | Handle |

DETAILED DESCRIPTION OF THE PREFERRED EMBODIMENTS

Preferred embodiments of the present invention are described below.

Figure 1:
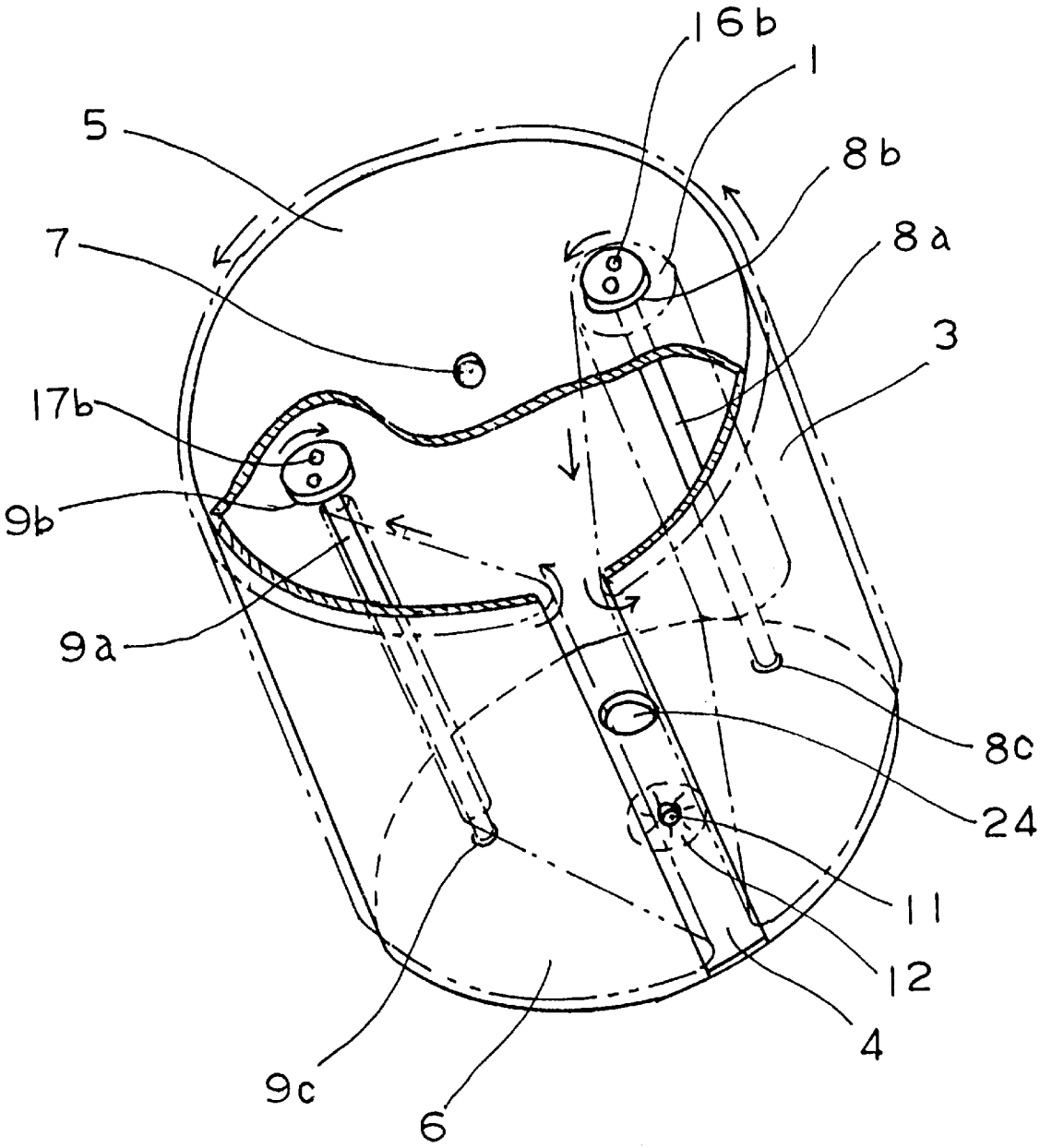
FIG. 1 is the partially sectioned perspective view of cylinder of a winding adhesive cleaner according to the invention.

FIG. 1 shows a cylinder (3) with an opening (4) including a roll of adhesive paper (1) and a winding shaft **(9*a*). The paper drawn from the roll (1) gets out of the cylinder (3) through the opening (4), laid along the round of said cylinder to be wound on the winding shaft (9*a*) put in said cylinder through the opposite side of said opening (4). The cylinder (3) is closed with two end plates (5) and (6) at both ends, the end plate (5) having a center hole (7) to insert a center shaft (10) and two supporting holes; (8*b*) for sustaining an unwinding shaft (8*a*) with the roll of adhesive paper and (9*b*) for sustaining the winding shaft (9*a*), the end plate (6) having a center hole (11) with a stopper (12) and two supporting holes; (8*c*) for sustaining the unwinding shaft (8*a*) and (9*c*) for sustaining the winding shaft (9*a*), the stopper (12) to be fit with a stopper channel (15) on the top of the center shaft (10)** to prevent slip-off.

Figure 2:
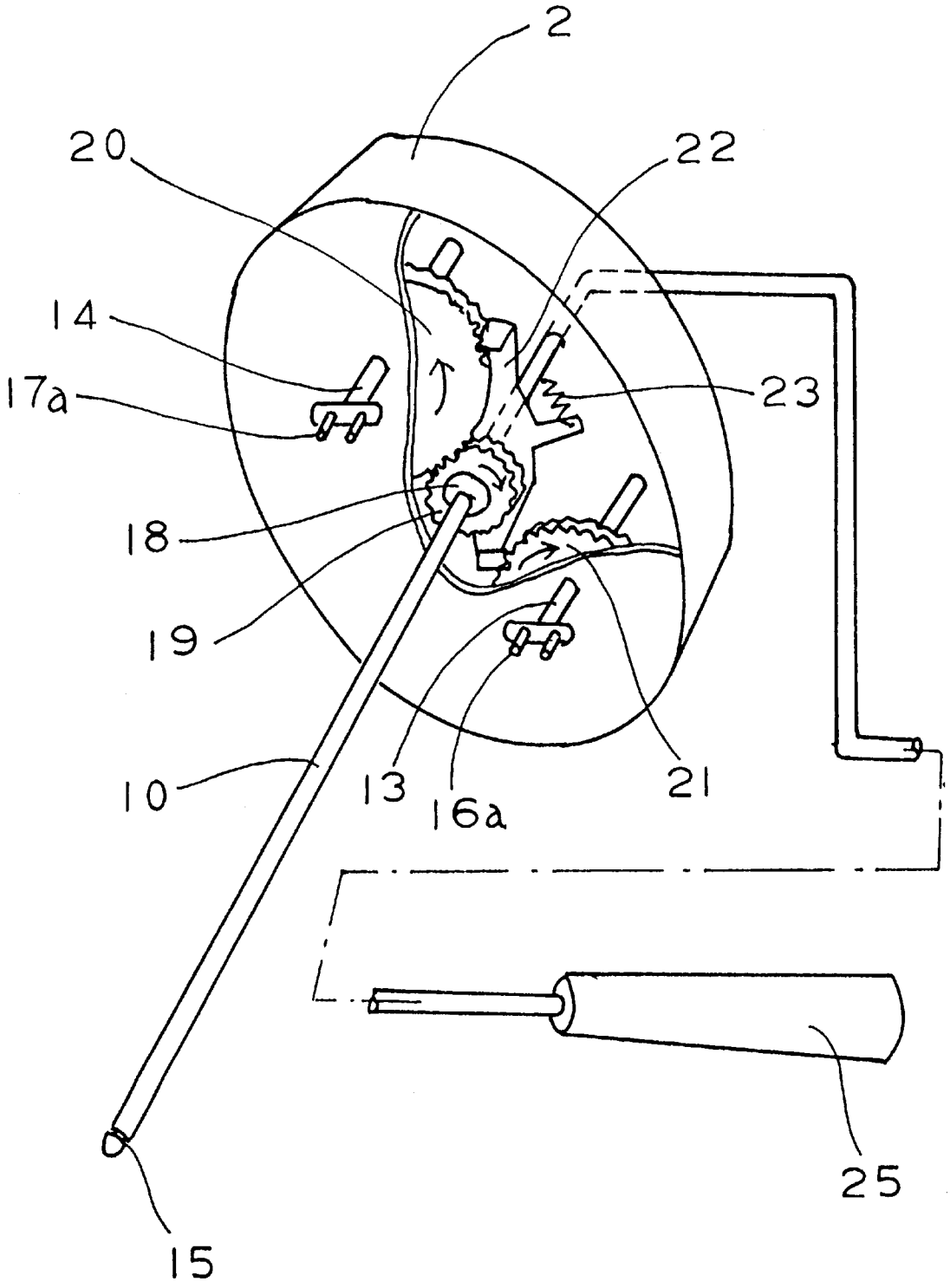
FIG. 2 is the partially sectioned perspective view of main body of a winding adhesive cleaner according to the invention.

On an end of the unwinding shaft **(8*a*), socket holes (16*b*) are equipped, which are fit with projections (16*a*) put on an unwinding gear shaft (13) shown in FIG. 2. Also on an end of the winding shaft (9*a*), socket holes (17*b*) are equipped, which are fit with projections (17*a*) put on a winding gear shaft (14) shown in FIG. 2**.

In a gear box (2), the center shaft (10) is equipped with a one-way bearing (18) joined with a driving gear (19) to enable the shaft rotation only in the arrow direction. The winding gear shaft (14) is equipped with a winding gear (20) engaging with said driving gear (19). The unwinding gear shaft (13) is equipped with a ratchet gear to prevent reverse rotation.

An arm with backstop claw (22) is equipped on the center shaft (10) at the arm's fulcrum, each end of the arm being pressed on the winding gear (20) and the ratchet gear (21) respectively using a spring (23) to prevent slip or reverse rotation of them. In this status, the winding gear (20) can't rotate by itself or the ratchet gear (21) can't rotate reverse but can advance only in the arrow direction.

On the end of the unwinding gear shaft (13), the projections (16*a*) are equipped to fit in the socket holes on the unwinding shaft (8*a*). On the end of the winding gear shaft (14), the projections (17*a*) are equipped to fit in the socket on the winding shaft (9*a*).

To prepare the operation of this cleaner, the cylinder (FIG. 1) should be held and the center shaft (10) should be inserted into the cylinder through the center holes (7) and (11) to fit with the stopper at the stopper channel (15). At the same time, the projections (16*a*) and (17*a*) should be fit with the socket holes (16*b*) and (17*b*) respectively to join the unwinding shaft (8*a*) and the winding shaft (9*a*) with the unwinding gear shaft (13) and the winding gear shaft (14). This is the end of preparation before operation.

Figure 3:
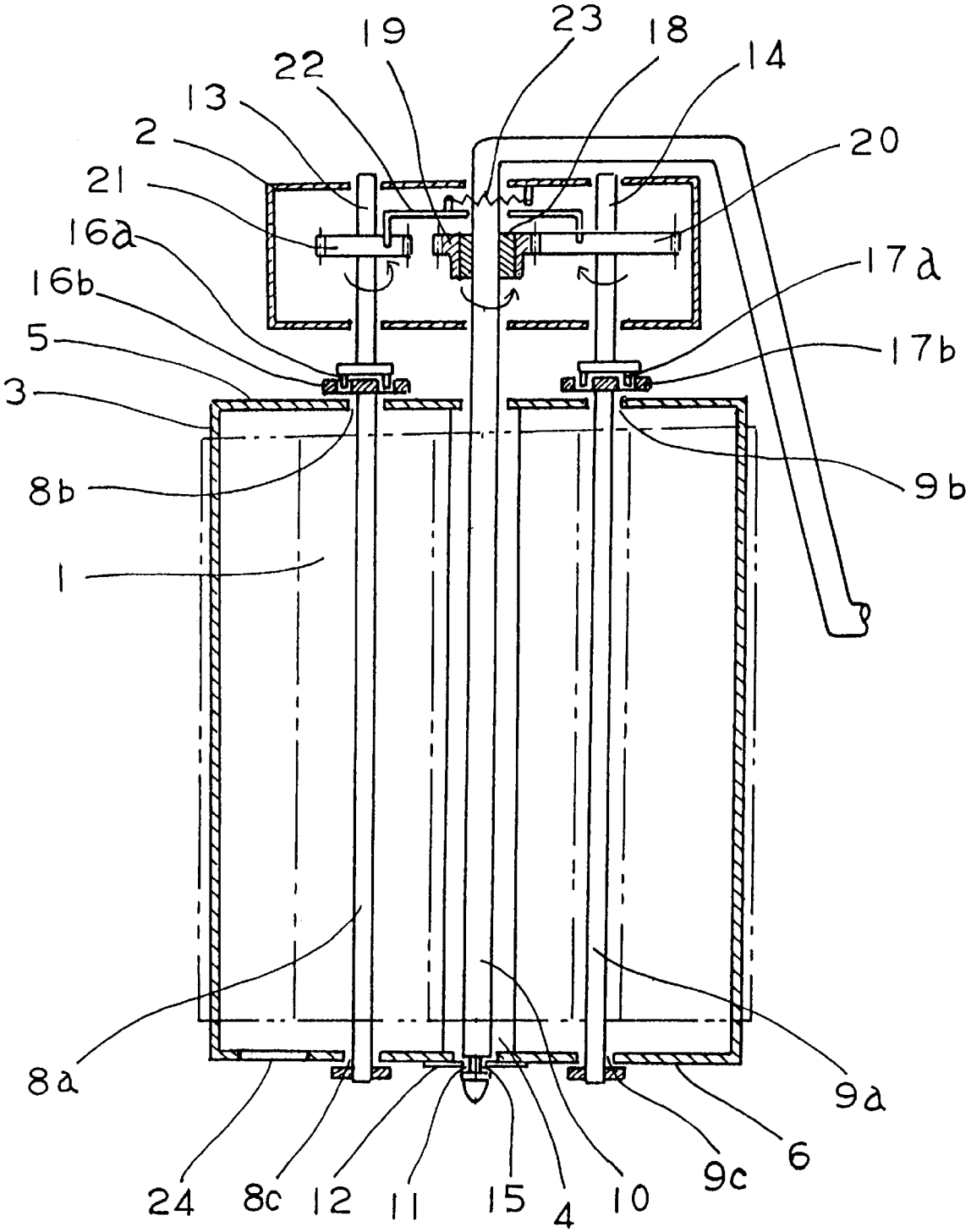
FIG. 3 is the sectional view of a winding adhesive cleaner according to the invention after said cylinder is assembled with said main body.

FIG. 3 shows the sectional view of combination of the cylinder (FIG. 1) and the body (FIG. 2). When the handle (25) is held and the cylinder is moved back and forth pressing onto the floor, the one-way bearing (18) slips around the center shaft (10) on the forth way together with the driving gear (19) but the winding gear (20) engaged with the driving gear doesn't rotate. Thus said cylinder and said body (gear box) turn on said center shaft without rotation of the winding shaft (9*a*) or the roll of adhesive paper (1) to attract dust. In other words, the center shaft turns against the cylinder and the gear box.

On the back way, said one-way bearing (18) fixed on said center shaft is locked. Then said driving gear (19) is also stopped. However the winding gear (20) fixed on the winding gear shaft (14) starts the planet motion around said driving gear (19) as said cylinder continues rolling on the floor. Then the top of the arm with backstop claw biting the winding gear (20) is forced up with the motion, the opposite top of the arm also being forced up against the ratchet gear (21). The lock of the unwinding shaft (8*a*) and the winding shaft (9*a*) is released to wind the adhesive paper.

When the back motion of the cylinder stops, both tops of said arm again bite said winding gear (20) and said ratchet gear (21) respectively to lock them.

The winding adhesive cleaner according to the invention described above realizes a new ideal feeding system that adhesive paper laid on the cylinder (3) is wound up into the cylinder at the most dirtied part after running around the cylinder and that the fresh adhesive face is always fed at the same time. If the cleaner is lifted up unexpectedly when it is sticking on the floor, adhesive paper isn't drawn out to loosen because the unwinding shaft (8*a*) and the winding shaft (9*a*) are both locked at the same time when the cleaner is stopped. Even if adhesive paper is slackened a little, it will be dissolved through rotation of the cylinder. The cylinder can also be turned hanging a finger in a winding hole (24) to dissolve slackened paper or even to prepare fresh adhesive face all round of the cylinder.

When all of fresh adhesive face is consumed, the cylinder (FIG. 1) is taken off from the center shaft (10) to throw away.

A winding adhesive cleaner according to the invention has the effects as follows:

(1) Adhesive face is continuously changed without removing dirtied face or suspending cleaning operation;

(2) Operation without touching dirty adhesive face directly with fingers is very sanitary;

(3) Cleaning time is remarkably shortened and fatigue for cleaning is reduced;

(4) A cylinder after consumed can be thrown away; and (5) Through above effects, cleaning mind is encouraged to achieve clean life environment.

What is claimed is:

1. A winding adhesive cleaner comprising a roll of adhesive paper (1), a cylinder (3) having an opening (4) in the length direction and end plates (5,6) on both ends, the end plates being equipped with center holes (7,11), an unwinding shaft (8*a*) with socket holes (16*b*) and a winding shaft (9*a*) with socket holes (17*b*), one of the end plates being equipped with a stopper (12) on its center hole (11), a gear box (2) having a center shaft (10) equipped with a one-way bearing (18), thereon a driving gear (19) and an arm with backstop claw (22), the center shaft having a stopper channel (15) at a top and connecting to a handle (25), the driving gear engaging a winding gear (20) provided on a winding gear shaft (14) which is equipped with projections (17*a*), a claw of said arm (22) connecting to a ratchet gear (21) provided on an unwinding gear shaft (13) which is equipped with projections (16*a*), and said center shaft (10) penetrates said center holes, (7,11) to fit said stopper (12) in said stopper channel (15), said projections (16*a*) of said unwinding gear shaft fitting in socket holes (16*b*) at the end of the unwinding shaft (8*a*), projections (17*a*) of said winding gear shaft fitting in socket holes (17*b*) at the end of the winding shaft (9*a*), and said roll of adhesive paper being set to the unwinding shaft (8*a*).

* * * * *